United States Patent [19]

Kaczmarek

[11] 4,437,602

[45] Mar. 20, 1984

[54] NAIL DRIVING TOOL

[76] Inventor: Jerome A. Kaczmarek, 9409 Grand Division Ave., Cleveland, Ohio 44125

[21] Appl. No.: 931,204

[22] Filed: Aug. 4, 1978

[51] Int. Cl.[3] ..... B25C 1/02

[52] U.S. Cl. ..... 227/147

[58] Field of Search ..... 227/147, 120; 206/338

[56] References Cited

U.S. PATENT DOCUMENTS 1,772,950 8/1930 Joy ..... 227/147

3,672,738 6/1972 Buttriss ..... 206/338

3,695,499 10/1972 Taylor ..... 227/147

*Primary Examiner*—John McQuade

*Attorney, Agent, or Firm*—Watts, Hoffmann, Fisher & Heinke Co.

[57] ABSTRACT

A nail driving tool allowing continual visual observation of nail by the user while the nail is being driven. The tool includes a driver member for transferring a hammer impact force to a nail head, a guide member having a transparent driving end, and a frictional element, mounted to the guide member, frictionally engaging the driver.

2 Claims, 2 Drawing Figures

NAIL DRIVING TOOL

BACKGROUND OF THE INVENTION

This invention relates generally to hand tools and in particular to nail driving devices.

Nail driving tools have been proposed including a nail guide member for supporting a nail being driven and a ram member for transmitting nail driving forces to the nail. These tools were generally employed to drive in nails at inaccessible locations and to prevent damage to the surface surrounding the nail by the hammer blows. Fundamentally, a nail driving tool serves to isolate the hammer from the nail and the area surrounding the nail, while concurrently transmitting the force of the hammer impact to the nail head in a controlled manner.

If the user of a nail driving tool is unable to see the nail or to gauge the depth to which it has been driven, he may "overdrive" the nail. Overdriving the nail will result in damage to the nailed surface and/or render the fastening function of the nail ineffectual.

Nail driving tools have been proposed which were provided with mechanical stops to prevent overdriving, as illustrated by U.S. Pat. Nos. 4,054,237 and 2,657,382. These nail driving tools were intended to drive nails to a given depth. If a different nail depth was desired, modification or replacement of the mechanical stop was necessary.

Other proposed nail driving tools were provided with visual indicators to indicate the position of the ram member within the guide member. This type of nail driving tool is disclosed in U.S. Pat. Nos. 1,772,950 and 2,672,610. Nail driving tools employing indicia could only indicate discreet ram positions and if the marks were numerous, confusion could easily result.

The nailing depth accuracy of the above-mentioned nail driving tools would be sensitive to the nail head dimensions for in these tools, the depth to which a nail was driven was partly dependent upon the shape of and/or the thickness of the nail head. The thicker the nail head, the deeper the nail would be driven in.

A proposed nail driving tool disclosed in U.S. Pat. No. 3,061,835 included a guide formed by separable jaws which when separated allowed partial viewing of the nail as it was initially driven; however, as the nail head approached the nailing surface, the jaws obscured the nail head making it difficult to determine nailing depth. In general, this tool would be complex and expensive to manufacture. Moreover the presence of externally moving parts would render the use of the tool cumbersome.

In certain circumstances, for example the installation of aluminum siding, the ability to control the depth to which the nail is driven is especially important. Overdriving the nail will usually cause the nail head to pierce the siding. More importantly, the nail head should not ever be driven into contact with the siding in order to allow for thermal expansion and attendant siding movement. Nailing of the aluminum siding is thus very critical.

The prior suggested nail driving tools are not adaptable for use in this application. The inability to view the nail is detrimental to their use. Nail driving tools employing indicia on either the ram or the guide member would lack the flexibility needed for this nailing application.

SUMMARY OF THE INVENTION

The present invention provides a nail driving tool having a transparent guide member portion which allows viewing the nail as it is being driven. The transparent guide member portion enables the user to view the nail during the entire driving operation and nails can be precisely driven to any desired depth without requiring the presence of indicia on the tool. The nailing depth is independent of the shape or size of the nail head.

In a preferred embodiment, the nail driving tool of the present invention includes an elongated tubular guide member having a wall defining a nail receiving guideway. The guide member includes a driving end having an opening from which a nail is driven and an opposite end. The guide member wall extends continuously about the opening and is formed from a material which is transparent to electromagnetic radiation in the visible spectrum thus permitting the nail in the guide to be observed from outside the guide member. The guide member wall further defines an internal nail guiding surface extending at least part way through the guideway.

An elongate driver member receives the hammer impact force and transfers it to the nail head. The driver defines a rigid nail engaging surface at one end and a rigid anvil-like surface at its opposite end adapted to be struck with a hammer. The driver extends into the opposite end of the guide member and has a cross-sectional shape which generally conforms to the shape of the guideway.

A driver positioning element is located on one end of the guide member. In the preferred embodiment the positioning element comprises an elastomeric cup-shaped structure having a centrally disposed aperture sized to frictionally engage the outer periphery of the driver member. The frictional engagement between the driver and positioning element serves to maintain the initial position of the driver and further serves to minimize the rebound of the driver after each hammer impact.

A nail driving tool constructed according to a preferred embodiment of the invention is especially suited for the installation of aluminum siding. The guide member wall provides a support surface against which adjacent siding is propped preventing the siding from obstructing the view of the nail as it is being driven. The transparent guide member portion allows the user to continually observe the nail as it is being driven and thereby facilitate nailing depth accuracy. The positioning element assures that the driver remains appropriately positioned for striking the nail head without excessive rebounding.

Other features and advantages of the invention will become apparent from the following detailed description of a preferred embodiment made in reference to the accompanying drawings.

DESCRIPTION OF A PREFERRED EMBODIMENT

Figure 1:
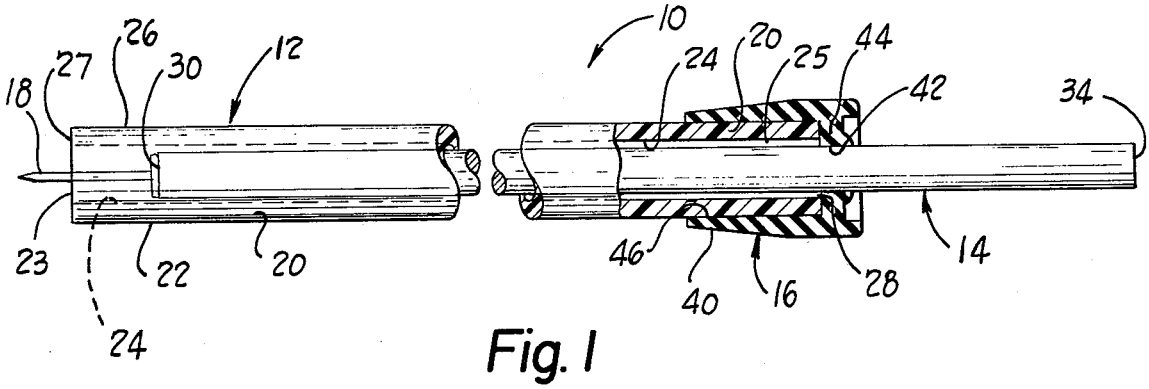
FIG. 1 is an elevational view of a nail driving tool embodying the present invention having portions broken away and shown in cross-section.

FIG. 1 illustrates a nail driving tool 10 constructed according to a preferred embodiment of the invention which includes a guide member 12, a driver member 14 and a frictional positioning element 16. A nail 18 is supported by the guide member and the driver member transmits the force of a hammer blow to the nail for driving the nail. The positioning element 16 is frictionally engaged between the guide member and the driver member and maintains them assembled.

The guide member 12 is an elongate generally tubular structure. It includes a continuous wall 20 defining an outer surface 22 and an inner surface 24. The inner surface 24 defines a cylindrical through passage or guideway 25. A nail driving end section 26 of the guide forms an opening 23 through which nails are inserted into the guideway 25 and a planar end face 27 surrounding the opening 23 for abutting the surface into which the nail is driven. The plane of the endface 27 preferably extends at right angles to the direction of extent of the guideway 25 which in turn provides a continuous support for the nail.

The opposite end of the guide member 12 frictionally receives the element 16 and further forms an end opening 28 through which the driver member 14 extends into the guideway.

The length of the guide member 12 is chosen to accommodate the expected application. The guide member must provide sufficient support for the nail and preferably be of a length which will allow it to be firmly gripped by a full hand width. Additionally, the guide member must be of a length which will enable the nail driving tool to be used in remote locations where accessibility and the hammering area are limited.

The driver member 14 as shown in FIG. 1 is an elongate rod-like structure. Its cylindrical cross-sectional shape generally conforms to the cylindrical interior guideway 25 with suitable clearance to provide supportive coaction between it and the guide member 12. The driver 14 includes a nail driving end surface 30 adapted for engaging the head of the nail 18 and an impacting end surface 34 adapted to receive the hammer impact. The length of the driver 14 is preferably greater than that of the guide member so that the nail head is driven into contact with a nailing surface before the impacting surface 34 moves to a position flush with the end of the frictional element 16. The driver is preferably constructed of a hard metallic material so that the end surface 30 is not unduly deformed during use. Excessive end deformation could cause interference between the driver and the inner guide member wall 24 and render the use of the tool difficult. For most applications a low temper or cold rolled steel rod stock is an appropriate material due to its chipping and fracture resistance and its ability to provide the requisite driver rigidity. Although it is not imperative that the impacting end surface 34 of the driver 14 completely resist excessive distortion by the hammer impacts during use, it is nevertheless advantageous to minimize this possibility by use of driver member material durable enough to withstand the expected hammer impact force.

The frictional positioning element 16 as shown in FIG. 1 is generally cup-shaped and is preferably constructed from a pliable, resilient elastomeric material. It includes a frustum portion 40 terminating in a radially extending web 44 defining an aperture 42. The frustum portion 40 includes a bore 46 having an inner diameter which is sized to establish an interference fit between the outer surface of the guide member 12 and an inner surface of the frustum 40. The diameter of the aperture 42 is less than the diameter of the driver 14 so that frictional engagement is established between these two components. To insure that the frictional element 16 remains securely positioned on the guide member 12, the interference fit between the frictional element 16 and the outer surface of the guide member 12 must generate a frictional force which is greater than the frictional force generated between the aperture 42 and the driver 14. If removability of the frictional element 16 is not desired, it can be fixedly secured to the outer surface of the guide member with a suitable adhesive.

The frictional element 16 serves a two-fold purpose. Firstly, it prevents the driver 14 from sliding unrestrained within the guide member 12, a condition which would make the retention of the nail in the opening 23 extremely difficult. Essentially, it releasably retains the driver 14 in its initial position prior to the nailing operation. Secondly, the frictional element minimizes the rebound reaction of the driver after each hammer impact. Absent this element, the driver 14 would bounce back unimpeded upon contacting the nail head after the hammer impact and would render the use of the tool difficult.

During the useful life of the nail driving tool, the end surface 27 of the guide member may eventually exhibit wear, surface irregularity, damage, etc., occasioned by the percussive-like contact between the guide member and the nailing surface. Ordinarily, to remedy this condition, the grinding or filing of the end surface 27 to its original configuration would be required. In the preferred embodiment however, this periodic repair is partially obviated. As shown in FIG. 1, the guide member is cross-sectionally symmetrical and uniformly dimensioned along its longitudinal axis. This characteristic coupled with the homogenous material construction allows either end of the guide member 14 to be used as the driving end. Thus, if one end of the guide member becomes damaged, the frictional element 16 can be removed from the opposite end and reinserted on the damaged end, thereby providing a new guide member end surface 27. This feature essentially increases the time interval between repairs to the guide member end surface.

In accordance with the present invention, the end section 26 of the guide member 12 is constructed from a material which is transparent to electromagnetic radiation in the visible spectrum, to allow the observation of the nail as it is being driven. One such material is polycarbonate, a relatively rigid plastic. In the preferred embodiment, the entire guide member is constructed from one material. This avoids the necessity of joining the transparent end section to another guide member section in order to form a unitary structure. A homogenous material construction of the guide member is preferred because of its cost effectiveness and manufacturing simplicity.

The disclosed nail driving tool is very useful in the installation of aluminum siding especially in those situations in which a sheet of siding, already installed, overhangs and obstructs the placement of a sheet of siding to be installed. This situation is illustrated in FIG. 2.

Figure 2:
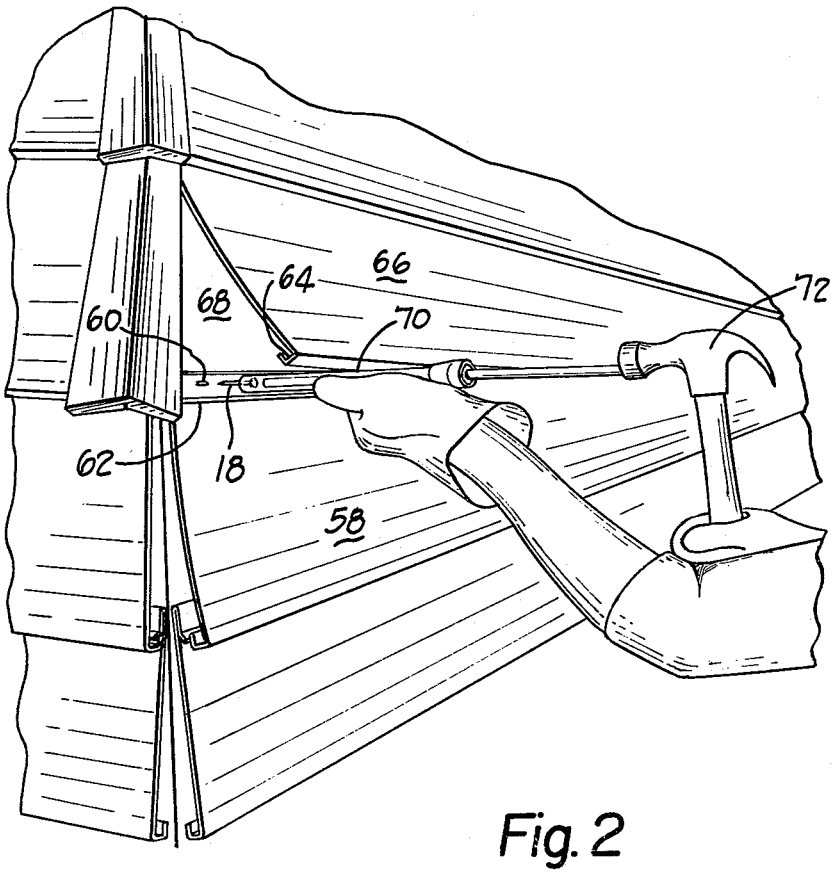
FIG. 2 is a perspective view of the nail driving tool of FIG. 1 being used in the installation of aluminum siding.

A sheet of aluminum siding 58 as shown in FIG. 2 generally has a series of laterally spaced mounting holes disposed along its upper edge, one of which is designated by the reference character 60. A longitudinal lip 62 is located below the mounting holes and is adapted to engage a complimentary lip 64 on a sheet 66 immediately above. The siding 58 is first nailed to the surface 68 and then the lip 62 is engaged by the companion lip 64 to lock the siding 66 to the side of the house.

It has been found that a nail driving tool having the following dimensionsis especially suited for use in the installation of aluminum siding:

Guide Member (12) Dimensions:
- Overall length—9"
- Outer diameter—$\frac{5}{8}$"
- Inner diameter—$\frac{3}{8}$"
- Wall thickness—$\frac{1}{8}$"
- Material—polycarbonate Driver Member (14) Dimensions:
- Length—12"
- Diameter—5/16"
- Material—steel rod stock To use the nail driver, the driver 14 is first retracted a distance sufficient enough to allow a nail to be inserted into the opening 23. The driver is then positioned so that the surface 30 of the driver abuts the head of the nail 18. The nail driving tool with the nail inserted is then positioned so that the shank of the nail extends through the aperture 60 of the aluminum siding and contacts the nailing surface 68. The overhanging siding 66 shown in FIG. 2 is supported by the outer surface of the guide member at the location indicated by the reference character 70 and thus is prevented from obscuring the user's view of the nail as it is being driven. A hammer 72 is then used to strike the end surface 34 of the driver 14 displacing the driver towards the nailing surface causing abutting contact with, and the transmission of the hammer force to, the nail head resulting in nail displacement into the nailing surface. The user continually observes the position of the nail by looking through the transparent guide member 12 and thus can carefully control the depth to which the nail is driven.

It should be apparent that a novel nail driving tool is presented in this invention. Its cost effective construction coupled with its transparency offers functional advantages and benefits not found in many prior art devices. By appropriate sizing and dimensioning, the nail driving tool can be made to meet a variety of applications and uses.

While only a single preferred embodiment of the invention has been illustrated and described in detail the invention is not to be considered limited to the precise construction shown. Various adaptations, modifications and uses of the invention may occur to those skilled in the art to which the invention relates and the intention is to cover all such adaptations, modifications and uses which fall within the spirit or scope of the invention as described and hereinafter claimed.

I claim:

1. A nail driving tool comprising:

(a) an elongated tubular guide member formed by a wall surrounding a nail receiving guideway, said guide member having a driving end forming an opening from which a nail is driven and an opposite end, said guide member wall extending continuously about said opening and formed from a material which is transparent to electromagnetic radiation in the visible spectrum thus permitting a nail in said member to be observed from outside of the guide member, said guide member wall defining an internal nail guiding surface extending at least part way through said guideway from said opening toward said opposite end;

(b) an elongated driver member defining a rigid nail engaging surface at one end and a rigid anvil-like surface at its opposite end adapted to be struck with a hammer, said driver member defining a body extending into said opposite end of said guide member and shaped to generally conform to the shape of said guideway; and, (c) positioning means frictionally engaged between said driver member and said guide member for limiting movement of said driver member relative to said guide member, said positioning means including an elastomeric cup-shaped element defining a bore for receiving one end of the guide member and an aperture, said driver member extending through said aperture and frictionally engaging said cup-shaped element.

2. The nail driving tool of claim 1 wherein said bore of said cup-shaped element is sized to provide an interference fit between the element and the end of the guide member.

* * * * *